US010703127B2

(12) United States Patent
Lefebvre et al.

(10) Patent No.: US 10,703,127 B2
(45) **Date of Patent: *Jul. 7, 2020**

(54) PRINTING METHOD WITH OXIDATIVE-DRYING INTAGLIO INK AND UV-VIS-CURABLE INTAGLIO INKS

(71) Applicant: SICPA HOLDING SA, Prilly (CH)

(72) Inventors: Olivier Lefebvre, Montagny-pres Yverdon (CH); Patrick Magnin, Maxilly-sur-Leman (FR); Christophe Schaller, Ollon (CH); Pierre Degott, Crissier (CH); Jean-Daniel Spitteler, Poliez-le-Grand (CH)

(73) Assignee: SICPA HOLDING SA, Prilly (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/691,415

(22) Filed: Nov. 21, 2019

(65) Prior Publication Data

US 2020/0086676 A1 Mar. 19, 2020

Related U.S. Application Data

(62) Division of application No. 14/387,032, filed as application No. PCT/EP2013/054861 on Mar. 11, 2013.

(30) Foreign Application Priority Data

Mar. 23, 2012 (EP) ..... 12160940

(51) Int. Cl.
*B41M 1/10* (2006.01)
*B41M 3/14* (2006.01)
(Continued)

(52) U.S. Cl.
CPC ..... *B42D 25/355* (2014.10); *B41F 9/01* (2013.01); *B41F 9/025* (2013.01); *B41M 1/10* (2013.01);
(Continued)

(58) Field of Classification Search
None
See application file for complete search history.

(56) References Cited

U.S. PATENT DOCUMENTS 3,390,631 A 7/1968 Koszul
5,264,289 A 11/1993 Kondo et al.
(Continued)

FOREIGN PATENT DOCUMENTS

CN 1474863 2/2004
CN 101250354 8/2008
(Continued)

OTHER PUBLICATIONS

Indian First Examination Report (FER) in counterpart Indian Application No. 7085/DELNP/2004 dated Aug. 21, 2018 (corresponding U.S. Appl. No. 14/387,032).
(Continued)

*Primary Examiner* — Joshua D Zimmerman
(74) *Attorney, Agent, or Firm* — Muncy, Geissler, Olds & Lowe, P.C.

(57) ABSTRACT

The present invention relates to the field of the intaglio printing process. In particular, the present invention relates to a method that combines intaglio inks curable by oxidation with UV-VIS-curable intaglio inks on one intaglio plate or cylinder. The disclosed method results in an intaglio printed security element using advantageously the unalike properties of the different inks while enabling the printing on a standard printing press in one printing step.

11 Claims, 7 Drawing Sheets

(51) Int. Cl.

| | |
|---|---|
| ***B42D 25/355*** | (2014.01) |
| ***B42D 25/378*** | (2014.01) |
| ***B42D 25/29*** | (2014.01) |
| ***B41F 9/01*** | (2006.01) |
| ***B42D 25/324*** | (2014.01) |
| ***B42D 25/351*** | (2014.01) |
| ***B41F 9/02*** | (2006.01) |
| ***B42D 25/387*** | (2014.01) |
| ***B42D 25/405*** | (2014.01) |

(52) U.S. Cl.

CPC ..... *B41M 3/14* (2013.01); *B42D 25/29* (2014.10); *B42D 25/324* (2014.10); *B42D 25/351* (2014.10); *B42D 25/378* (2014.10); *B42D 25/387* (2014.10); *B42D 25/405* (2014.10)

(56) References Cited

U.S. PATENT DOCUMENTS

| | | | |
|---|---|---|---|
| 6,547,970 | B1 | 4/2003 | Shinoda |
| 6,613,137 | B2 | 9/2003 | Egger et al. |
| 7,615,110 | B2 | 11/2009 | Leonard et al. |
| 2003/0220419 | A1 | 11/2003 | Sekioka et al. |
| 2005/0193909 | A1 | 9/2005 | Mayer et al. |
| 2009/0145314 | A1 | 6/2009 | Botrie |
| 2010/0139511 | A1 | 6/2010 | Schaede |
| 2010/0236432 | A1 | 9/2010 | Foresti et al. |

FOREIGN PATENT DOCUMENTS

| | | |
|---|---|---|
| DE | 4444034 | 6/1996 |
| EP | 0091709 | 10/1983 |
| EP | 0358610 | 3/1990 |
| EP | 0406157 | 1/1991 |
| EP | 0432093 | 6/1991 |
| EP | 0563007 | 9/1993 |
| EP | 0873866 | 10/1998 |
| EP | 0927749 | 7/1999 |
| EP | 1246876 | 10/2002 |
| EP | 1260563 | 11/2002 |
| EP | 1602482 | 12/2005 |
| EP | 1751240 | 2/2007 |
| EP | 1790701 | 5/2007 |
| EP | 2065187 | 6/2009 |
| GB | 1469717 | 4/1977 |
| JP | S2150112 | 12/1977 |
| JP | 2009227702 | 10/2009 |
| JP | 2011068748 | 4/2011 |
| JP | 2011173376 | 9/2011 |
| WO | 2001038101 | 5/2001 |
| WO | 2003066759 | 8/2003 |
| WO | 2007062271 | 5/2007 |
| WO | 2009003169 | 12/2008 |
| WO | 2009013169 | 1/2009 |
| WO | 2009156400 | 12/2009 |
| WO | 2010115286 | 10/2010 |
| WO | 2011046083 | 4/2011 |

OTHER PUBLICATIONS

Bleikolm ("New Design Opportunities with OVI" in Optical Security and Counterfeit Deterrence Techniques II, Proceedings of SPIE, vol. 3314, p. 213-230 (1998)).

Decision of Grant issued for Russian Application No. 2014139912/12 dated Feb. 27, 2017 (and English language translation) (corresponding U.S. Appl. No. 14/387,032).

Search report issued for Russian Application No. 2014139912/12 dated Feb. 20, 2017 (corresponding U.S. Appl. No. 14/387,032).

Japanese Office Action in counterpart Japanese Application No. P2015-500839 dated Jan. 18, 2017 (and English language translation) (corresponding U.S. Appl. No. 14/387,032).

Taiwan office action in counterpart Taiwan Application No. 102108027 dated Aug. 18, 2016 (and English-language translation) (corresponding U.S. Appl. No. 14/387,032).

Chinese Office Action in related Application No. 201380015947.3 dated Sep. 30, 2015 (and English language translation.) (corresponding U.S. Appl. No. 14/387,032).

PRINTING METHOD WITH OXIDATIVE-DRYING INTAGLIO INK AND UV-VIS-CURABLE INTAGLIO INKS

CROSS REFERENCE TO RELATED APPLICATIONS

This application is a Divisional of co-pending application Ser. No. 14/387,032, filed on Sep. 22, 2014, for which priority is claimed under 35 U.S.C. § 120; which is a 371 application of PCT Application No. PCT/EP2013/054861, filed on Mar. 11, 2013, and which claims priority of Application No. 12160940.8 filed in the European Patent Office on Mar. 23, 2012 under 35 U.S.C. § 119; the entire contents of all of which are hereby incorporated by reference.

INTRODUCTION

The present invention is in the field of the intaglio printing process, also referred to as engraved steel die printing process. In particular, a method is disclosed which combines intaglio inks curable by oxidation with UV-VIS-curable intaglio inks on one intaglio plate or cylinder. The method of the present invention results in an intaglio printed security element using advantageously the unalike properties of the different inks while enabling the printing on a standard printing press in one printing step.

BACKGROUND OF THE INVENTION

Intaglio printing refers to a printing method used in particular in the field of printing security documents.

In the intaglio printing process, a rotating engraved steel cylinder carrying a plate engraved with a pattern or image to be printed is supplied with ink by one or by a plurality of selective inking cylinder(s) (or chablon cylinders), each selective inking cylinder being inked in at least one corresponding colour to form multi-shade visible features.

Furthermore, the intaglio printing process involves a wiping off of any ink excess present on the surface of the intaglio printing device. The wiping off process is carried out using a paper or a tissue wiping system ("calico"), or a polymeric roll wiping system ("wiping cylinder"). Because of the amount of waste material and of the printing speed on an industrial printing press, the wiping off with a rotating wiping cylinder is increasingly preferred; wiping off with paper or tissue is practically not used anymore on an industrial printing press. The wiping cylinder is in turn cleaned in a bath comprising a solvent or an aqueous solution; or the wiping cylinder is cleaned with a solution spray; optionally brushes or Scotch-Brite™ material may also be used additionally. Because of environmental concerns and regulation on volatile organic compounds, cleaning of the wiping cylinder with solvent is practically not used anymore. Typically the washing solution used to clean the wiping cylinder is a basic aqueous solution comprising caustic soda and surfactant such as e.g. sulfated castor oil (SCO).

Subsequently, the plate is brought into contact with a substrate, e.g. with a paper, a composite or a plastic material in sheet form or web form, and the ink is transferred under pressure from the engravings of the intaglio printing device onto the substrate to be printed forming a thick printing pattern on the substrate.

FIG. 2*a* shows a schematic representation of an intaglio printing press. In the FIG. 2*a*, the represented intaglio printing press operates with a direct inking process.

In FIG. 2*a*, the cylinder (100) represents the cylinder carrying the intaglio plate. Each of the devices (110) and (111), (112) and (113), and (114) and (115) represent a fountain and an ink train for three separate intaglio inks. The fountain functions as a reservoir of intaglio ink. Each intaglio ink is supplied from its individual ink fountain well. Each ink train consists in a series of rollers. The ink train facilitates the distribution and the transfer of the ink from the fountain to the cylinder carrying the intaglio plate. Within each ink train, an inking roller ((110), (112) or (114)) coated with a polymeric material transfers the corresponding intaglio ink to a chablon ((111), (113) or 115)). A chablon of an intaglio printing press is a sheet of material comprising some relief on which the ink is deposited; the chablon is located between the roller of each ink train that is located next to the intaglio plate, and the intaglio plate on the plate cylinder (100). The ink is forced from the relief of the chablon into the engravings of the intaglio plate.

The intaglio ink is transferred from the chablons into the engravings of the intaglio plate; however some ink excess may also be transferred onto the non-engraved surface of the plate. The ink excess on the surface of the plate cylinder is removed either by cleaning the cylinder carrying the intaglio plate (100) with a wiping cylinder (120) and a cleaning solution; or, alternatively, the ink excess from the surface of the cylinder is removed from the cylinder (100) by wiping with a paper or a tissue ("calico"). From the plate cylinder (100), the ink is transferred to the substrate to be printed (130) under high pressure, to form the printed intaglio features (180). Typically, a pressure of several tens to several hundreds of bars is applied during an intaglio printing process. A counter-pressure cylinder (170) is located on the opposite side of the substrate.

The ink fountains, the rollers (110), (112) and (114) of the ink trains, and the plate cylinder (100) are usually equipped with temperature control system. Typical settings for intaglio printing press involve the ink fountain being kept at 20° C. while the plate cylinder is maintained at a temperature around 60° C. to 80° C.

The printing press shown in FIG. 2*a* may be used with oxidatively drying intaglio inks. In this case, the non-metallic parts of the printing press, in particular the rollers (110), (112) and (114) of the ink trains, and the corresponding chablons (111), (113) and (115), are typically made of rubber, preferably PUR rubber. The wiping cylinder (120) is typically made of polyvinyl chloride (PVC) or rubber.

When oxidatively curable intaglio inks are used to print an intaglio feature, the intaglio ink hardening starts immediately after the removal of the printed substrate from the intaglio printing cylinder (100). The oxidative curing may however typically be accelerated by a thermal treatment of the printed feature. The intaglio printing press shown in the FIG. 2*a* is equipped with a heat source (140), e.g. a hot air drier. Such a heat source is typically used with oxidatively curable intaglio inks to accelerate the ink hardening.

In an alternative intaglio process called Orlof process after the name of its inventor and schematically represented in the case of an intaglio press in FIG. 3*a*, the intaglio ink is transferred from the ink trains and the chablons to a collecting cylinder (160), called the "blanket", which, in turn, transfers the inks to the cylinder (100) carrying the intaglio plate; finally the inks are printed from the plate cylinder (100) onto the substrate (130) to form the printed intaglio features (180). The process is called indirect inking process. The indirect intaglio inking process brings in particular two benefits: reduced ink consumption and new design possibilities; in particular, the design possibilities benefit from the extremely precise inking and colour splits.

Intaglio printing presses have been described in detail e.g. in EP 0 091 709 A1, EP 0 406 157 A1, EP 0 563 007 A1, EP 0 873 866 A1, EP 1 602 482 A1 or US 2010 0 139 511 A1.

Intaglio printing delivers the most consistent and high quality printing of fine lines. It is the printing technology to be chosen for generating fine designs in the field of security documents, in particular banknotes and stamps.

One of the distinguishing features of the intaglio printing process is that the intaglio relief may be varied from a few micrometers to several tens of micrometers by using correspondingly shallow or deep recesses on the intaglio printing device. This ability to vary the intaglio relief is characteristic of the intaglio printing process and is used to confer tactility to the printed document. The intaglio relief results from the intaglio ink layer thickness which is emphasized by the embossing of the substrate produced by the pressure during the ink transfer. The tactility resulting from intaglio printing gives the banknotes their typical and recognizable touch feeling.

Due to the intaglio relief, intaglio printed devices are particularly prone to potential problems such as e.g. set-off and/or blocking problems.

"Set-off", which is the transfer of ink from one printed sheet to the back side of the next following printed sheet in the stack, or to the back of an endless sheet in a web, is a problem that may be encountered with any industrial printing process, in particular gravure and intaglio printing methods: the pronounced relief of gravure printing methods may accentuate the problem of set-off. Thus, interleave sheets between adjoining sheets have been used to solve this issue; however interleave sheets add additional material and handling costs to the printing process, reduce the maximal printing speed and need to be removed before the next printing step. With the state of the art oxidatively drying intaglio inks, the set-off issues have been reduced through the optimization of the ink formulation; however, deep engraving features may still result in undesirable set-off.

"Blocking" in the stack or in the reel, which is the sticking adhesion of one printed sheet to the back side of the next printed sheet in the stack, or to the back of an endless sheet in a web, is a fault that results from the weight or the pressure in the stack or in the web, and from the affinity of the printed ink for the backside of the next sheet or the backside of the endless sheet in the web; the problem may be encountered with any industrial printing process, in particular with gravure printing methods. Tactile features or thick printed layers printed with gravure printing process may in particular favour the occurrence of blocking since the weight of the stack or the web is concentrated on the tactile features thus producing an increased pressure on these thick-layered embossed areas.

Alternatively the set-off and blocking issues have been solved by the development of new UV-VIS-curable intaglio inks, as disclosed for instance in EP-1 260 563 A1, EP-0 432 093 A1 or US 2009/0 145 314 A1: UV-VIS-irradiation leads to very fast ink curing, in particular surface curing, and hence reduces drastically the set-off issue. Intaglio printing with UV-VIS-curable intaglio inks has proven to be particularly useful for difficult engraving design, for instance for deep engraving (thick ink layers): the instant surface curing of UV-VIS-curable inks prevents the set-off issues.

FIG. 2*b* shows a schematic representation of an intaglio printing press similar to the printing press of FIG. 2*a*; however, the thermal source (140) of FIG. 2*a* has been substituted with a source of electromagnetic radiation (150) for the UV-VIS curing of a UV-curable intaglio ink.

Printing presses, e.g. intaglio printing presses, usually comprise metallic elements and elements made of polymeric material. In the case of an intaglio printing press, the polymeric material elements include in particular the rollers of the ink trains, the chablons and the wiping cylinder.

The polymeric material used for these polymeric material elements consists for instance of rubber, polyurethane rubber (PUR rubber), silicone rubber, polyvinyl chloride (PVC), polyfluoroethylene (Teflon), ethylene propylene diene monomer (EPDM). In order to increase the lifetime of the polymeric material elements, the polymeric material is selected according to the type of ink to be used; in particular, the polymeric material of the elements which are continuously in contact with the inks, such as e.g. the rollers and the chablons, is selected such as to ensure an optimum lifetime of these elements. For instance, for oxidatively drying inks, PUR rubber is preferred; on the other hand, for UV-curable inks, EPDM is preferred to PUR rubber because the monomer and/or oligomer components of UV-curable inks tend to cause swelling and/or stickiness of PUR rubber. Examples of material used for the polymeric elements are disclosed e.g. in WO 2009/013 169 A1; WO 2003/066 759 A1; Rubber rollers in today's printing processes, T. L. Traeger, Rubber World, Oct. 1, 1999; Böttcher Systems in bottcher.com).

Thus in FIG. 2*b*, the non-metallic parts of the printing press are preferably made of material compatible with UV-curable intaglio inks; in particular, the rollers (110), (112) and (114) of the ink trains, and the corresponding chablons (111), (113) and (115), are preferably made of material compatible with UV-curable inks, such as e.g. EPDM material. The wiping cylinder (120) is typically made of polyvinyl chloride (PVC) or rubber.

In the Orlof process, as used in intaglio printing or in offset, the collecting cylinder is made of a woven fabric material coated with rubber. Examples of blanket material comprise e.g. polyurethane rubber (PUR rubber), acrylonitrile butadiene rubber (NBR); examples are given e.g. in U.S. Pat. No. 5,264,289 A, WO 2007/062271 A and JP 2011/173376-7 A.

In order to increase the lifetime of the blanket, the fabric material of the blanket is selected according the ink composition to be used. Nevertheless, some materials, e.g. acrylonitrile butadiene rubber (NBR), silicone rubber, show excellent resistance to both oxidatively drying inks and UV-curable inks and are thus used preferably (see e.g. U.S. Pat. No. 5,264,289 A).

Curing of oxidatively drying inks is typically a slow process which results in a higher tendency of the oxidative inks, as compared to UV-VIS-curable inks, to produce set-off. Furthermore, the relatively slow drying process of the oxidatively drying inks results also in slower printing process as compared to the UV-VIS-curing process.

Furthermore, thick transparent colourless indicia printed with oxidatively drying inks tend to turn yellow upon aging. Thus for the intaglio printing of transparent thick ink layers, UV-VIS-curable inks are preferred.

Due to their fast or almost immediate curing, intaglio printing with UV-VIS-curable inks allows reducing the time between printing and handling of the printed substrates, and increasing the number of stacked sheets per pile. The presence of volatile organic compounds can be avoided with intaglio UV-VIS-curable inks. UV-VIS-curable intaglio inks are also significantly more stable on the printing press than oxidatively drying inks.

A shortcoming of the UV-VIS-curable intaglio inks is their significantly higher cost which contributes very much to their marginal market penetration.

Some attempts to combine the advantages of both technologies in one ink have been disclosed. For instance, WO 2011/046083 A1, JP 2009/227702 A and JP 2011/068748 A disclose an intaglio ink composition comprising a UV-VIS-curable composition, an oxidation-curable composition, a photoinitiator, an oxidation polymerization catalyst and a pigment. WO 2003/066759 A1 discloses a similar composition wherein the UV-VIS-curable component of the intaglio composition is water-soluble.

The high pressure applied during the intaglio printing process may also serve as a means for sealing the surface of a substrate, e.g. paper, even in the non-intaglio printed areas; thus intaglio printing contributes to preserve a document against soiling. EP 2 065 187 B1 KBA-NotaSys discloses a process using transparent or semi-transparent intaglio inks applied on at least 80% (the percentage is based on the total surface of one side of the security paper) of the surface of the security papers in order to prevent the soiling of the substrate. Thus EP 2 065 187 B1 discloses a process principally directed at varnishing the substrate than at printing a particular intaglio security feature. In EP 2 065 187 B1, no details concerning the composition of the used intaglio inks are given.

Sequential intaglio printing with an oxidatively drying ink and UV-VIS-curable ink has been disclosed e.g. in DE 4 444 034 A1; the disclosed method, however, is a two-step printing process which requires the modification of the commonly used intaglio printing equipment.

It would be highly desirable to create specific intaglio designs such as for instance, but not limited to, the juxtaposition of a highly pigmented ink layer and a thick transparent intaglio ink layer (as for instance for tactile blind/low-vision features) in one printing step on one intaglio cylinder, in an improved way.

None of the above prior art documents discloses the simultaneous use of oxidative-drying and of UV-VIS-curable intaglio inks on one cylinder to produce specific intaglio security features.

SUMMARY OF THE INVENTION

The present invention discloses a method for printing a security element by combining two or more intaglio inks applied in one printing step from one sole intaglio device. The two or more intaglio inks are selected so that the printing process combines at least one oxidative drying ink and at least one UV-VIS-curable ink.

Described herein are processes for printing a security element on at least one side of a substrate with two or more intaglio inks characterized in that at least one of said two or more intaglio inks is an oxidative drying intaglio ink, at least one other of said two or more intaglio inks is a UV-VIS-curable intaglio ink, and the said one and one other of said two or more intaglio inks are printed in one printing step using one intaglio printing device, and the excess of the said two or more intaglio inks are wiped off from said printing device using a paper or a tissue wiping system.

Also described herein are processes for printing a security element on at least one side of a substrate with two or more intaglio inks characterized in that at least one of said two or more intaglio inks is an oxidative drying intaglio ink, at least one other of said two or more intaglio inks is a UV-VIS-curable intaglio ink, and the said one and one other of said two or more intaglio inks are printed in one printing step using one intaglio printing device, and the excess of the said two or more intaglio inks are wiped off from said printing device using a polymeric cylinder wiping system and an alkaline aqueous wiping solution.

Also described herein are security elements comprising an intaglio printed indicia applied by a process described herein, uses of said security elements to protect a security document and security documents comprising said security elements.

Also described herein are uses of the at least one oxidative drying intaglio ink and the at least one UV-VIS-curable intaglio ink described herein to print the security element described herein in one printing step using one intaglio printing device.

BRIEF DESCRIPTION OF THE DRAWINGS

The invention can be explained with the help of the following figures.

DETAILED DESCRIPTION

Figure 1:
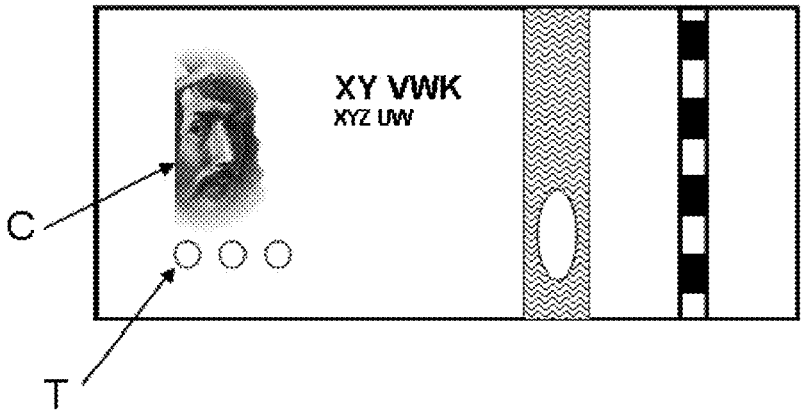
FIG. 1 schematically depicts a security document comprising an intaglio printed security element printed with the process of the present invention.
Figure 2A:
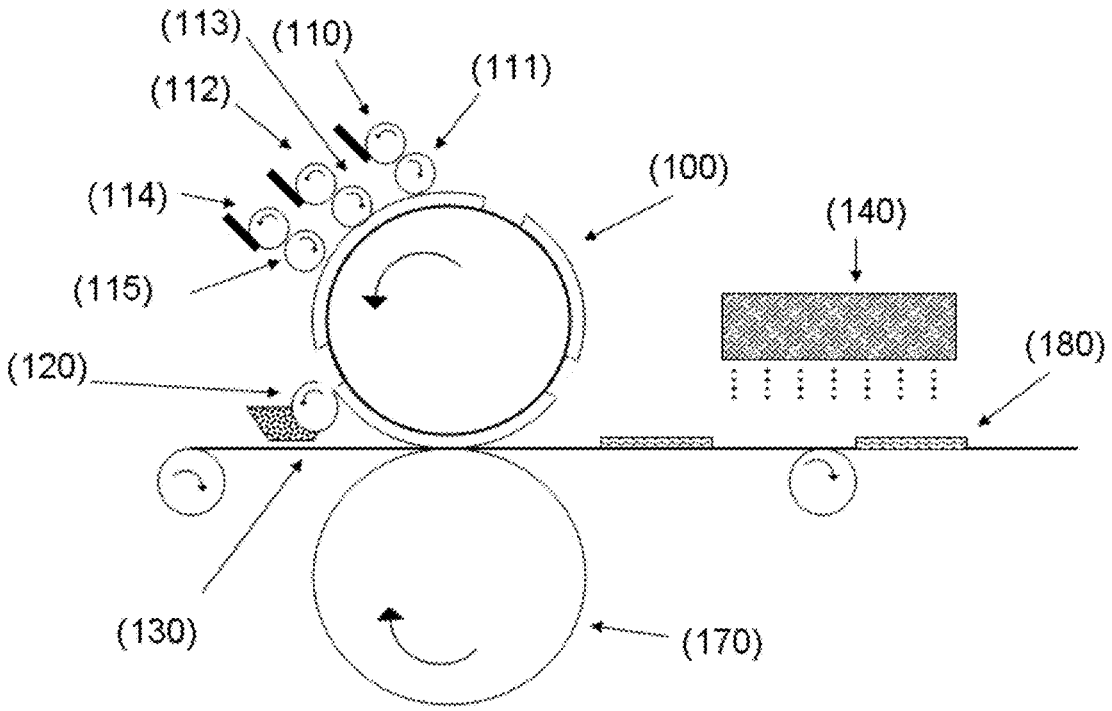
FIG. 2*a* schematically depicts an intaglio printing press useful for a direct inking process and comprising a heat source.
Figure 2B:
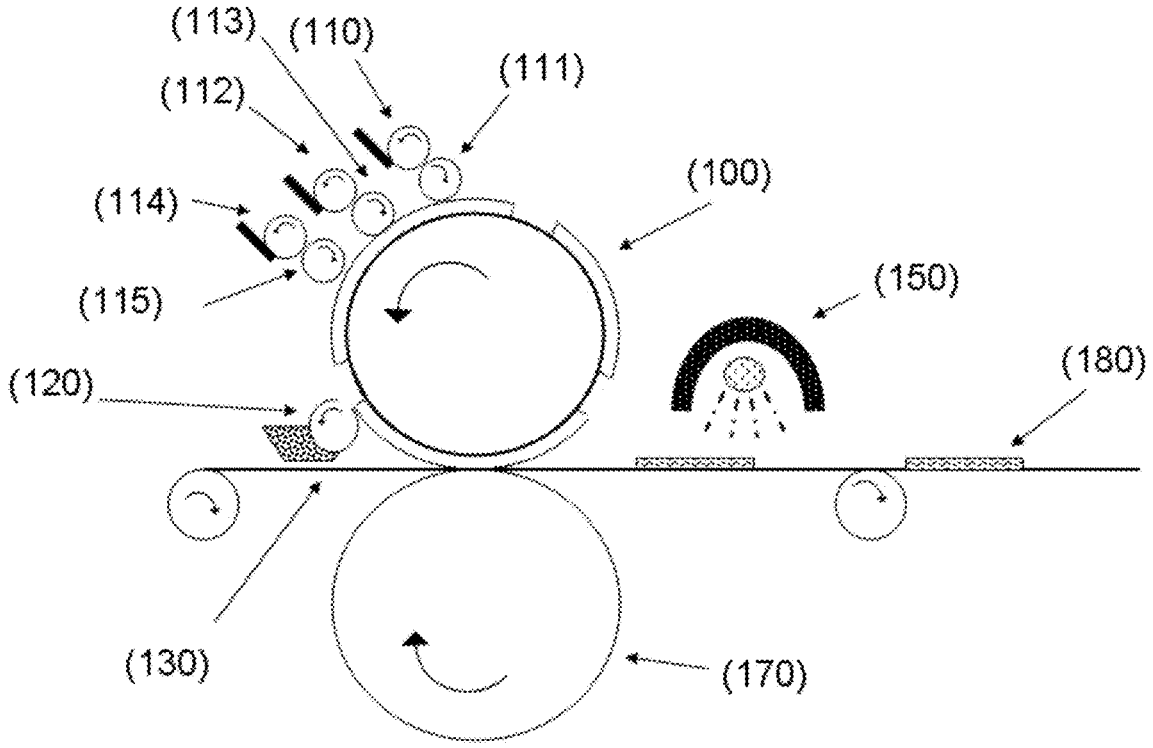
FIG. 2*b* schematically depicts an intaglio printing press useful for a direct inking process and comprising a source of electromagnetic radiation.
Figure 3A:
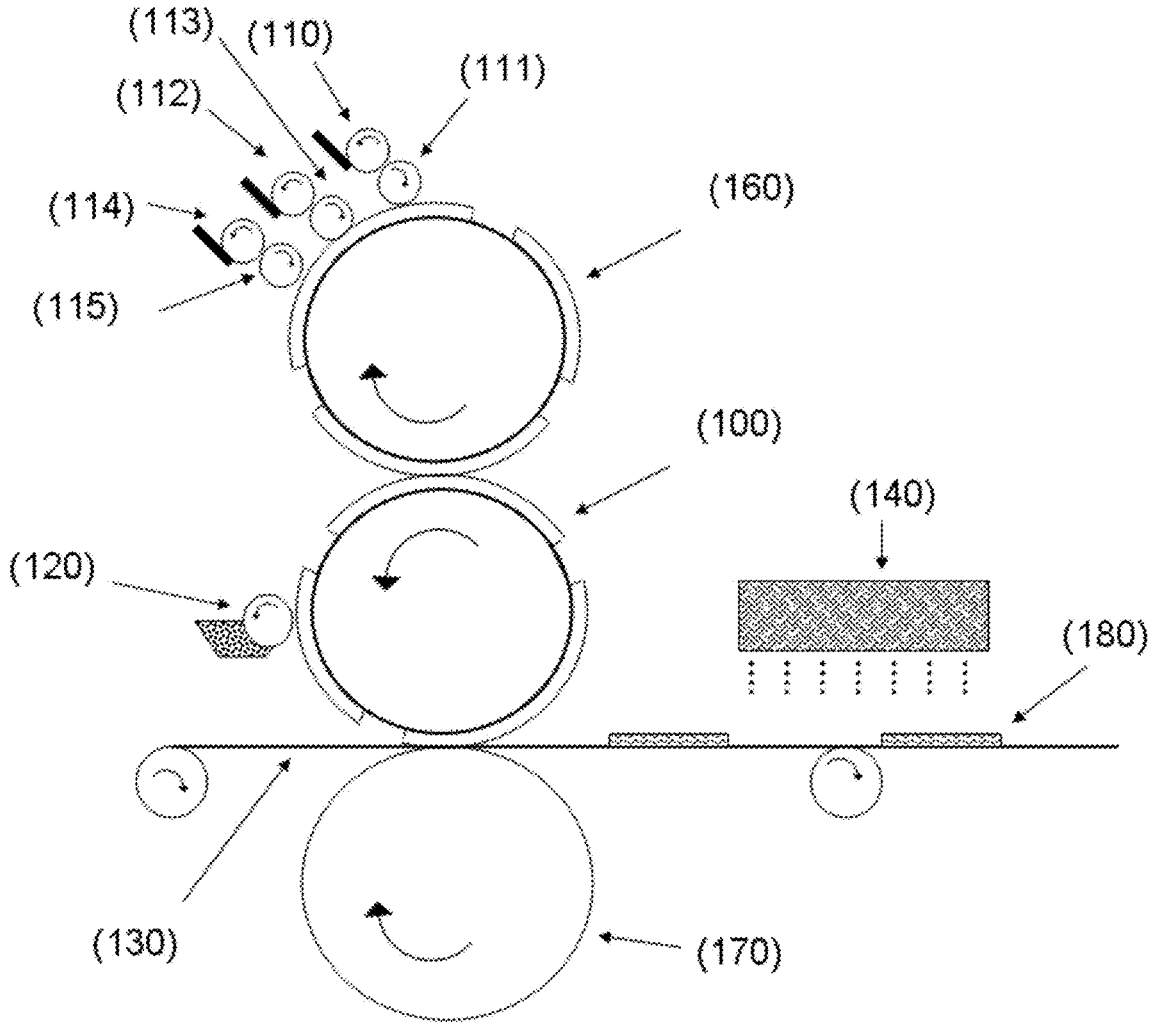
FIG. 3*a* schematically depicts an intaglio printing press useful for an indirect inking process (Orlof process) and comprising a heat source.
Figure 3B:
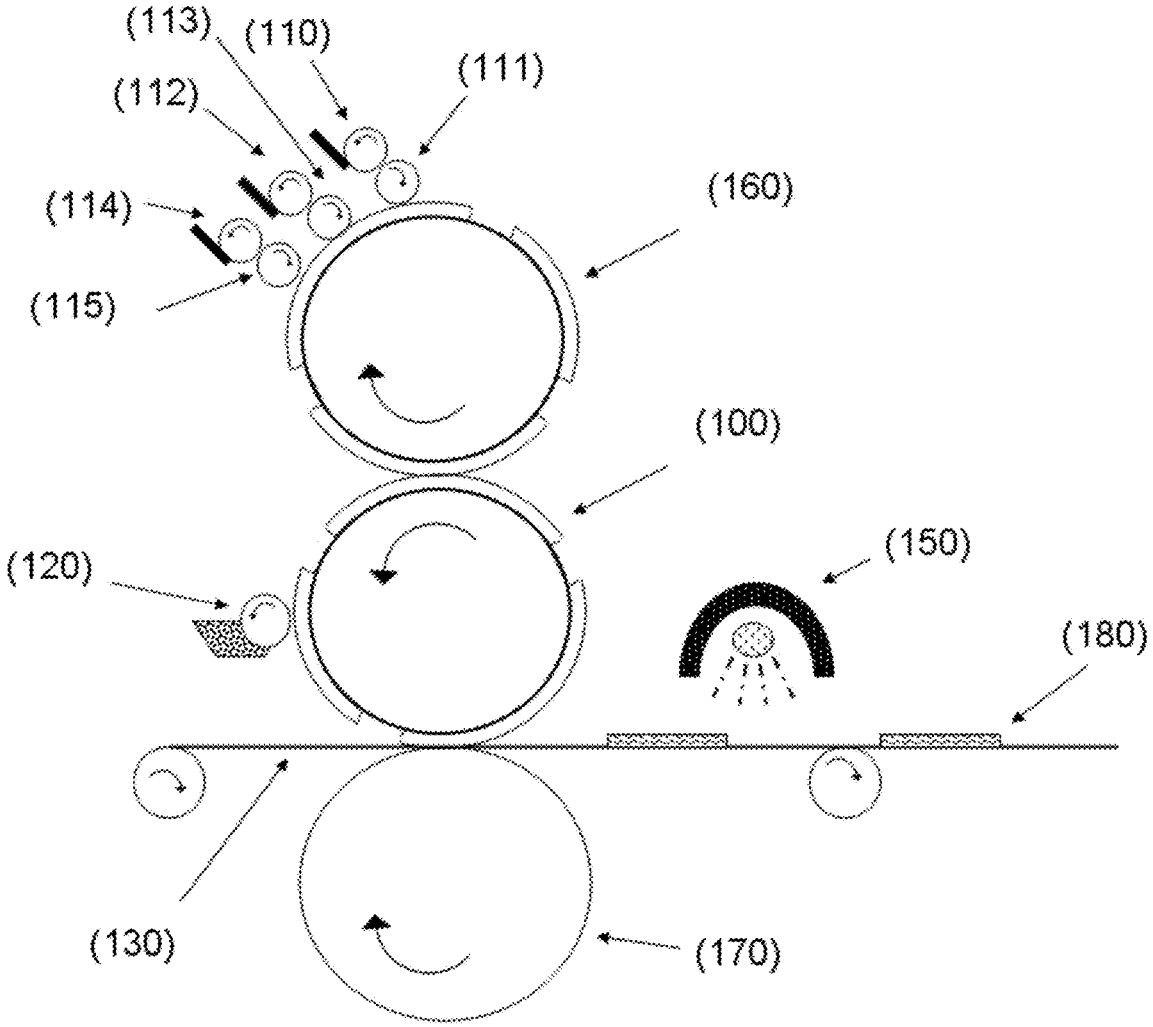
FIG. 3*b* schematically depicts an intaglio printing press useful for an indirect inking process (Orlof process) and comprising a source of electromagnetic radiation.

The present invention takes advantage of the complementary properties of oxidatively drying inks and UV-VIS-curable inks. Moreover, the solution of the present invention of using the oxidatively drying and the UV-curable inks in parallel simultaneously, and not sequentially, on one intaglio cylinder, is advantageous for economical reasons.

The present invention is furthermore related to the use of a security element disclosed herein for the protection against counterfeiting of a commercial good or a security document selected from the group consisting of the banknotes, value documents or cards, transportation tickets or cards, tax banderols, and product labels.

As used herein the term "security element" refers to an element on a security document printed with an intaglio printing process for the purpose of determining its authenticity and protecting it against counterfeits.

It is known in the art that UV-VIS-irradiation permeates poorly into a highly coloured coating layer, in particular thick coating layer. Thus, in a preferred embodiment of the present invention, the UV-VIS-curable intaglio ink is a colourless or tinted intaglio ink. The colourless or tinted UV-VIS-curable intaglio ink may be transparent or non-transparent; preferably the colourless or tinted UV-VIS-curable intaglio ink is transparent; even more preferably the UV-VIS-curable intaglio ink is a colourless transparent ink. The UV-VIS-curable intaglio is preferably used to print thick-layered tactile areas of the security element.

The average thickness of an intaglio relief is comprised between 1 μm and 100 μm, preferably between 10 μm and 60 μm, more preferably between 15 μm and 45 μm.

As used herein the term "intaglio relief" refers to the sum of the intaglio ink layer and the substrate embossing.

As used herein the term "intaglio ink layer thickness" refers to the thickness of the intaglio ink layer deposited on the substrate.

The intaglio ink layer thickness corresponds to the thickness of the intaglio relief minus the substrate embossing.

As used herein the term "UV-VIS-curable intaglio relief" refers to a security element printed with an intaglio printing process using a UV-VIS-curable intaglio ink. As used herein the term "oxidatively drying intaglio relief" refers to a security element printed with an intaglio printing process using a oxidatively drying intaglio ink.

As used herein, the term "transparent" means providing for optical transparency at least in part of the visible spectrum (400-700 nm). Transparent ink layers may be colourless; or alternatively transparent ink layers may be tinted, entirely or in part, provided that there is transparency in at least part of the visible spectrum, such as to allow an observer to see through the ink layer.

In a still further embodiment of the present invention, the printed cured UV-VIS-curable intaglio relief is thicker than the printed cured (dried) oxidatively drying intaglio relief. By selecting an appropriate design comprising a UV-curable intaglio ink layer and a oxidatively drying intaglio ink layer, the printed cured UV-VIS-curable intaglio ink relief being 10% to 50% thicker (the percentages refer to the thickness of the cured (dried) oxidatively drying intaglio relief), preferably 20% to 30% thicker, than the printed cured (dried) oxidatively drying intaglio relief, the mechanical pressure on the oxidatively drying intaglio relief in the stack of piled sheets or in the rolled web may be significantly reduced. Thus the present invention also discloses a method to reduce the set-off and/or the blocking of the oxidatively drying intaglio ink by reducing the mechanical pressure in the stack of piled sheets or in the rolled web, on the printed security feature made of an ink layer comprising an oxidatively drying intaglio ink.

The UV-VIS-curable ink suitable for the present invention is preferably a colourless or tinted, transparent or non-transparent ink. UV-Vis curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. UV-VIS-curable intaglio inks described herein typically comprise a) a binder compound which comprises oligomers (also referred in the art as prepolymers), preferably selected from the group consisting of radically-curable compounds, cationically-curable compounds and mixtures thereof. UV-Vis curing of a monomer, oligomer or prepolymer may require the presence of one or more photoinitiators and may be performed in a number of ways. UV-Vis curing may be done by a free radical mechanism, a cationic mechanism or a combination thereof. Depending of the binder compound(s) comprised in the UV-Vis curable composition, different photoinitiators might be used. The UV-VIS-curable intaglio ink may additionally comprise other additives; when a colourless transparent UV-VIS-curable intaglio ink is used, said additives are selected such that they do not alter the transparent properties of the UV-VIS-curable intaglio ink. Preferably the UV-VIS-curable intaglio ink may comprise one or more machine readable security compounds.

The term "intaglio device" refers to an engraved intaglio flat plate or to an intaglio plate adapted on a printing cylinder of an intaglio printing press.

The term "machine readable security compound" refers to security elements that may be detected by a machine, such as e.g. an ATM machine. Preferably, the machine readable security elements of the present invention are colourless components that are not visible to an un-aided human eye. The machine readable security compounds are selected from the group comprising UV-, VIS- or IR-absorbing materials, luminescent materials, magnetic compounds, forensic markers or taggants and combinations thereof. Examples of machine readable security compounds are disclosed in e.g. EP-0 927 749 B1, EP-1 246 876 B1 or WO 2010/115 286 A2.

In a preferred embodiment of the present invention, the UV-VIS-curable intaglio ink is partially or completely cured by UV or VIS irradiation immediately after the printing of the security element; thus the UV-VIS-curable intaglio ink is partially or completely cured when the oxidative curing process of the oxidatively curable intaglio ink starts. Or alternatively, a thermal treatment may be first applied to the security element, thus initiating and/or accelerating the oxidative curing process of the oxidatively curable intaglio ink, before a UV irradiation step. Preferably the UV or VIS irradiation is performed before the thermal treatment. In this preferred alternative, the heat emitted by the UV or VIS irradiation source may contribute favourably to the drying of the oxidatively drying intaglio ink.

According to the present invention, a typical intaglio printing press as known in the art may be used to print the oxidatively curable intaglio ink and the UV-VIS-curable intaglio ink in a single printing step with one intaglio device without significant modification of the press.

Figure 4A:
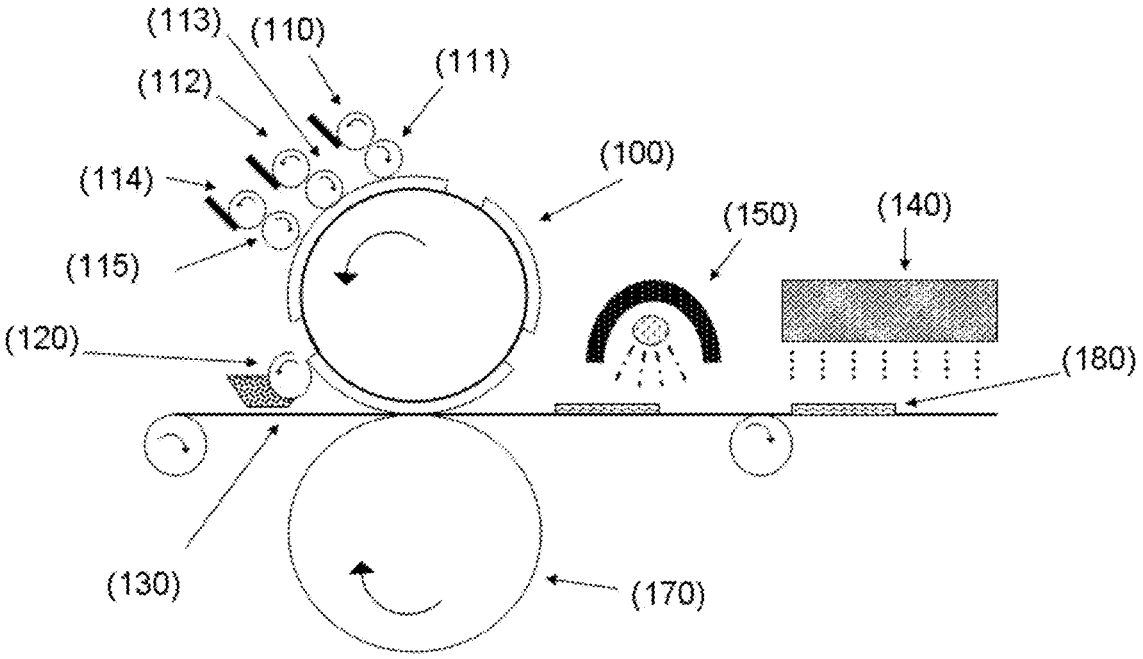
FIG. 4*a* schematically depicts an intaglio printing press useful for the process of the present invention to be used in a direct inking process. The printing press comprises a heat source and a source of electromagnetic radiation.

FIG. 4*a* shows a printing press suitable for the present invention, i.e. that may be used with oxidatively drying intaglio inks and UV-curable intaglio inks. The elements made of polymeric material, in particular the rollers (110), (112) and (114) of the ink trains and the corresponding chablons (111), (113) and (115), are selected preferably among materials showing optimal compatibility with the corresponding intaglio inks to increase their lifetime. In particular, the rollers among the rollers (110), (112) and (114) and the chablons among the chablons (111), (113) and (115) used for oxidatively drying inks are preferably made of rubber, more preferably of PUR rubber; the rollers among the rollers(110), (112) and (114) and the chablons among the chablons (111), (113) and (115) used for the UV-curable inks are preferably made of material compatible with UV-curable inks, more preferably of EPDM material.

The wiping cylinder (120) is made of usual material such as e.g. polyvinyl chloride (PVC) or rubber.

The printing press of FIG. 4*a* is equipped with a source of electromagnetic radiation (150) for the UV-VIS curing of a UV-curable intaglio ink and with a thermal source (140) to accelerate the hardening of the oxidatively drying ink. The source of electromagnetic irradiation (150) is preferably located between the plate cylinder and the heat source (140); however, the heat source (140) may also be positioned between the plate cylinder (100) and the source of electromagnetic radiation (150).

Figure 4B:
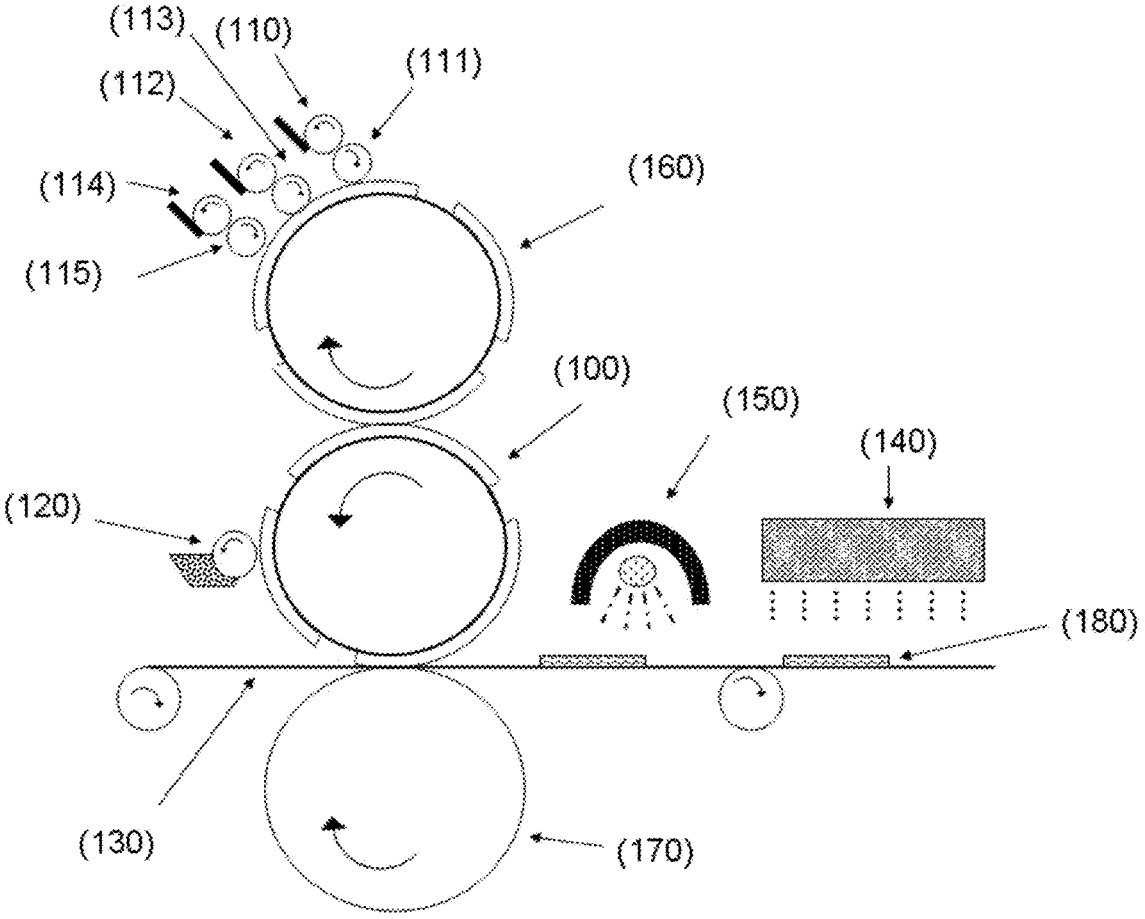
FIG. 4*b* schematically depicts an intaglio printing press useful for the process of the present invention to be used in an indirect inking process (Orlof process). The printing press comprises a heat source and a source of electromagnetic radiation.

FIG. 4*b* shows a printing press suitable for the present invention, i.e. that may be used with oxidatively drying intaglio inks and UV-curable intaglio inks, comprising a device for the indirect inking (Orlof process). The printing press of FIG. 4*b* is equipped with a source of electromagnetic radiation (150) for the UV-VIS curing of a UV-curable intaglio ink and with a thermal source (140) to accelerate the hardening of the oxidatively drying ink. As in the FIG. 4*a*, for the rollers (110), (112) and (114) of the ink trains and the corresponding chablons (111), (113) and (115), the material is preferably selected according to the intaglio inks to be used on each ink train. Thus the rollers among the rollers (110), (112) and (114) and the chablons among the chablons (111), (113) and (115) used for oxidatively drying inks are preferably made of rubber, more preferably of PUR rubber; the rollers among the rollers(110), (112) and (114) and the chablons among the chablons (111), (113) and (115) used for the UV-curable inks preferably consist of material compatible with UV-curable inks, more preferably of EPDM material.

The collecting cylinder (160) may preferably be made of material that is compatible with both the UV-curable and the oxidatively drying ink, such as e.g. acrylonitrile butadiene (NBR) and silicone rubber.

Compositions suitable for the present invention have been disclosed e.g. in EP 1 790 701 B1, EP 2 014 729 A2 or WO 2009/156 400 A1 (oxidatively drying inks); and in EP 1 260 563 B1 or EP 1 751 240 B1 (UV-curable inks).

Typical formulations suitable for the present invention include without limitation the following formulations:

formulation for an oxidatively drying intaglio ink:

| Component | weight-%[1] |
|---|---|
| Pigments | 4-40 |
| Extenders (e.g. alumina, calcium carbonate, china clay) | 10-50 |
| Resins (e.g. cellulose resins, long oil alkyd, polyamides, acrylic resins, vinyls, rosin-modified maleics | 10-30 |
| Solvents | 10-20 |
| Dryer (e.g. Co-octoate) | 0.1-3 |
| Wax | 1-7 |
| Surfactants | 1-10 |
| Additives (e.g. slip agent, anti-oxidant, stabilizer) | 0.1-5 |

[1]weight percents based on the total weight of the formulation.

formulation for a UV curable intaglio ink:

| Component | weight-%[1] |
|---|---|
| Pigments | 0-30 |
| Prepolymers | 20-35 |
| Monomers/oligomers | 10-30 |
| Fillers | 5-10 |
| Photoinitiators | 1-10 |
| UV_Stabilizer | 1-3 |
| Other additives (e.g. emulsifiers) | 1-5 |

[1]weight percents based on the total weight of the formulation.

The UV-curable intaglio ink and the oxidatively drying intaglio ink described herein may comprise further one or more additional security feature substances, preferably selected from, but not limited to, the group consisting of UV-, VIS- or IR-absorbing materials, luminescent materials, magnetic compounds, forensic markers or taggants and combinations thereof. Examples are disclosed in U.S. Pat. No. 6,200,628 and the like.

Hence the processes of the present invention do not require the development of new sophisticated intaglio inks. Regular oxidatively drying intaglio inks and regular UV-curable intaglio inks may be used to produce the security element according to the present invention.

A security element according to the present invention is depicted in an example in FIG. 1.

FIG. 1 schematically represents a banknote comprising an intaglio printed security element consisting of a human face printed with a pigmented intaglio ink (C) and of a series of tactile dots printed with a colourless intaglio ink (T). The intaglio printed security element may be printed in one printing step on one intaglio cylinder using e.g. an oxidatively drying intaglio ink for the pigmented part (human face) and a UV-curable intaglio ink for the colourless part (tactile dots) according to one of the preferred embodiment of the present invention.

The process of the present invention permits a faster printing of intaglio features combining UV-cured and oxidatively dried intaglio inks than with a sequential printing process of each intaglio ink.

In particular, the process of the present invention permits a faster printing of an intaglio element while improving setting-off and blocking behaviour by combining thicker UV-cured intaglio ink layers with thinner oxidatively dried intaglio ink layers.

The security elements produced with the process of the present invention are printed on a conventional intaglio printing press equipped with polymeric parts such as rollers and chablons compatible made of rubber, preferably of PUR rubber for the parts to be used with oxidatively drying intaglio inks, and with EPDM for the parts to be used with UV-curable intaglio ink.

Typically, suitable washing solutions for cleaning the wiping cylinder of the intaglio press used for the present invention are alkaline aqueous wiping solutions comprising between 0.3 wt-% and 1.2 wt-% (weight percent) of a strong base, such as e.g. sodium hydroxide NaOH, and between 0.3 wt-% and 1 wt-% (weight percent) of a surfactant, such as e.g. sulphated castor oil (SCO), the weight percents being based on the total weight of the alkaline aqueous wiping solution.

The security document of the present invention comprising the security element produced with the process of the present invention may comprise one or more additional security features such as e.g. threads, foils and/or windows. Alternatively, the security element printed with the process of the present invention may be printed on these one or more additional security features.

The invention claimed is:

1. Process for printing a security element on at least one side of a substrate with two or more different intaglio inks wherein at least one of said two or more different intaglio inks is an oxidative drying intaglio ink curable by an oxidative process, at least one other of said two or more different intaglio inks is a UV-VIS-curable intaglio ink curable by UV-VIS irradiation, the process comprising:

transferring the oxidative drying intaglio ink through rubber-made rollers, inking a first selected portion of a printing plate of said intaglio printing device with the oxidative drying intaglio ink, transferring the UV-VIS-curable intaglio ink through EPDM (ethylene propylene diene monomer) material-made rollers, inking a second selected portion of said printing plate, which does not overlap with said first selected portion, of said intaglio printing device with the UV-VIS-curable intaglio ink, wiping off the excess of the oxidative drying intaglio ink and the UV-VIS-curable intaglio ink from said intaglio printing device using a paper or a tissue wiping system, printing the oxidative dying intaglio ink onto a first area of the substrate corresponding to the first selected portion of the printing plate and the UV-VIS-curable intaglio ink onto a second area of the substrate corresponding to the second selected portion of the printing plate in one printing step using one intaglio printing device, wherein intaglio relief of the second area has a predetermined thickness larger than intaglio relief of the first area, curing the UV-VIS curable intaglio ink by exposure to the UV-VIS irradiation, and curing the oxidative drying intaglio ink by the oxidative process, wherein said UV-VIS-curable intaglio ink is a transparent and colorless ink, wherein the printed cured ink layer made from said UV-VIS-curable intaglio ink is thicker than the printed cured ink layer made from said oxidative drying intaglio ink.

2. Process according to claim 1 wherein said inking the first selected portion and the inking the second selected portion are performed by an indirect inking process using a first and a second chablons covering different non-overlapping areas of the intaglio printing device.

3. Process according to claim 1 wherein said security element is printed on an area covering less than 80% of the whole surface of the substrate.

4. Process according to claim 1 wherein the average intaglio relief of the cured ink layer made of said UV-VIS-curable intaglio ink is between 1 μm and 100 μm.

5. Process according to claim 1 wherein said UV-VIS-curable intaglio ink comprises one or more machine readable security compounds.

6. Process according to claim 1 wherein said substrate is a security document.

7. Process according to claim 1, wherein the UV-VIS-curable intaglio ink is partially or completely cured by UV or VIS irradiation by a source of electromagnetic radiation immediately after the printing of the security element, and wherein the curing of the oxidatively curable intaglio ink is accelerated by a heat source located downstream of the source of electromagnetic radiation.

8. Process according to claim 4 wherein the average intaglio relief of the cured ink layer made of said UV-VIS-curable intaglio ink is between 10 μm and 60 μm.

9. Process according to claim 4 wherein the average intaglio relief of the cured ink layer made of said UV-VIS-curable intaglio ink is between 15 μm and 45 μm.

10. Process according to claim 6 wherein the security document is a banknote, a passport, a check a voucher, an ID- or a transaction card, a stamp, or a tax label.

11. Process according to claim 1, wherein the printed cured ink layer made from said UV-VIS curable intaglio inks is 10% to 50% thicker than the printed cured ink layer from said oxidative drying intaglio ink.

* * * * *